United States Patent [19]

Dondelewski

[11] 4,357,145

[45] Nov. 2, 1982

[54] CARBONACEOUS PELLETS AND METHOD OF MAKING

[76] Inventor: Michael A. Dondelewski, 5354 Fortress Trail, Columbus, Ohio 43230

[21] Appl. No.: 248,488

[22] Filed: Mar. 27, 1981

[51] Int. Cl.[3] ..... C10L 5/14

[52] U.S. Cl. ..... 44/20; 44/25

[58] Field of Search ..... 44/20, 15 R, 15 A, 1 G, 44/25

[56] References Cited

U.S. PATENT DOCUMENTS

| | | | |
|---|---|---|---|
| 2,036,642 | 4/1936 | Pukli | 44/20 |
| 2,675,304 | 4/1954 | Komarek | 44/15 R |
| 3,377,146 | 4/1968 | Stroh | 44/15 R |

FOREIGN PATENT DOCUMENTS

| | | | |
|---|---|---|---|
| 45-9255 | 4/1970 | Japan | 44/25 |
| 323698 | 1/1930 | United Kingdom | 44/20 |
| 881878 | 11/1961 | United Kingdom | 44/25 |
| 239209 | 7/1969 | U.S.S.R. | 44/15 R |

*Primary Examiner*—Charles F. Warren
*Assistant Examiner*—Margaret B. Medley
*Attorney, Agent, or Firm*—Webb, Burden, Robinson & Webb

[57] ABSTRACT

A method of pelletizing carbonaceous materials including bonding coal fines and lignite coal with a polymeric hydrocarbon binder having reactive sites thereon, for example, with tall oil pitch and the like. In the case of coal, the binder is applied by slurrying the fine coal with the pitch. In the case of lignite, binder is directly applied to the pulverized material. By action of rolling and tumbling, for example, large agglomerates are formed. With drying and heating, strong water-resistant pellets are formed which have the extremely desirable property of being easily repulverized.

4 Claims, No Drawings

CARBONACEOUS PELLETS AND METHOD OF MAKING

BACKGROUND

Fine coal, which is a by-product of the coal washing process, often is wasted. It is abandoned in slurry pits or land fills because of the difficulty in transporting and handling. It has been estimated that 28 million tons of coal fines now lie in blackwater ponds. Because it is very fine, when it is dried, it blows as dust. This makes it difficult to transport. When it wets out and freezes it can be impossible to handle. Moreover, once it wets out it does not easily dry out again. My copending U.S. patent application Ser. No. 178,620, filed Aug. 15, 1980 entitled "Method of Recovering and Using Fine Coal" relates to the process for recovering and pelletizing fine coal. This invention relates to another but related process. Very often coal materials are pulverized prior to burning. Hence a process for pelletizing fine coal should produce a pellet that, in addition to being strong and water-resistant, is also easily repulverized in existing equipment. Disclosed herein is a process for producing such a pellet.

One source of fuel that may become very important is lignite coal. Lignite is a mineral substance of vegetable origin which is a geological precursor of coal. It has a much lower heating value than coal, but because of its low sulfur content, may become a very desired fuel for industry. It has certain drawbacks however. It is highly hydroscopic. It takes up and releases water if stored in piles. This process results in crumbling and disintegration which is undesirable and makes shipping difficult. More important, however, the process of loss and gain of water can result in spontaneous combustion which limits the length of time the lignite can be stored. Studies have concluded that lignite cannot be safely shipped for distances of over 100 miles. For that reason, lignite must be "packaged" for shipment and storage. The process disclosed herein enables the pulverization and pelletization of lignite to provide a unique product. Prior pelletization processes have not been applicable to lignite because of its unique physical properties.

Agglomeration or pelletizing of fine particles has been known for a long time. It has also been known that each material has a unique set of conditions under which it is pelletized, if indeed, it can be pelletized. Binders used in pelletizing fine materials have included the following: hydrolized starches, sulfites, mineral oils, and even in some cases only water. Some binders impart sufficient wet strength to agglomerated materials but upon drying do not supply dry strength or survive rewetting.

British Pat. No. 183,430 (1921) teaches agglomerating finely divided carbonaceous material by mixing with water and hydrocarbon oil. The recovery product is an agglomerated mass containing from 10 to 15 percent moisture. The British patent does not suggest that hardened pellets are formed nor would that be expected. The quantities of fuel oil suggested as the hydrocarbon oil would not be compatible with today's fuel oil prices.

U.S. Pat. No. 3,148,140 of Kaiser et al. suggests use of a "water-immissible organic solvent" for recovering of carbon particles from water. The specific solvents named are hydrocarbons, namely hexane, pentane, benzene, toluene, xylene, light naphthas, or mixed paraffin fractions. These volatile materials (boiling range from 35° to 200° C.) can hardly be candidates for oven dried pellets nor is it likely that they would remain upon drying to bind the fine coal. The quantities of solvent suggested are far from economical.

U.S. Pat. No. 3,696,923 by Miller relates to recovery of coal fines through froth flotation. Preferred flotation agents comprise MIBC, pine oil and even fuel oil. The small quantities added are far from sufficient to act as a binder, if indeed, they do.

U.S. Pat. No. 3,043,426 by Noone relates to recovery of fine coal particles by froth flotation utilizing hydrocarbon materials (kerosene and methyl isobutyl carbinol) in very small quantities that are far from sufficient to act as a binder.

A recent study for the U.S. Department of Energy by Babcock Contractors of Pittsburg, Pa. has developed information relating to pelletizing lignite, using an asphaltic emulsion as the binder. The strength of the pellets so made only ranges from 20 to 25 psi. Asphaltic emulsions contain undesirable contaminants such as sodium which may attack boiler tubes in the combustion process.

Having been exposed to the need to produce a strong, weather-resistant coal or lignite pellet, inexpensively, I have concluded that the binder used for such purpose must fuse the particles of carbonaceous materials by reacting with itself and/or with the coal particles. The binder must be fusable at relatively low temperatures and must not, upon drying exhaust noxious or flammable fumes into the atmosphere.

An essential aspect of this invention is a drying step, as in an oven, to remove moisture. Fine coal and lignite requires water to agglomerate to a suitable size. The water serves as a temporary binder but it is not desirable in the end product. Moreover, in certain embodiments of the process large amounts of water are associated with the fine coal either because it is being recovered from blackwater ponds or because the fines are slurried with the binder to achieve the desired coating. But, water in the final product is undesirable as it is useless weight, increasing transportation costs per BTU and decreasing the BTU content per ton.

Prior to my work, described in the above identified copending patent application, the suggested binders for coal fines were principally petroleum based hydrocarbons. No thought was given to fusing probably because the temperatures required would have resulted in ignition. Attempts by me to fuse coal fines with engine oil at temperatures below ignition temperature have produced only a weak pellet that crumbles with finger pressure.

Starches and sulfites have no apparent ability to completely fuse the pellets of coal fines. Moreover, when rewetted, the bond weakens. Thus the pellets made with starch and sulfide binders are neither strong nor waterproof. Sulfites also add sulfur to the coal which produces undesirable sulfur oxides in stack gases.

As disclosed in my copending application referenced above, fixed oils (vegetable oils as they are sometimes called) are extremely useful in agglomerating and fusing coal fines. Vegetable oils comprise unsaturated fatty acids (and esters thereof) which fuse when heated in air. They also have an affinity for coal surfaces in a water slurry such that when coal is slurried with an excess of vegetable oil, the coal particles only take up the amount of oil necessary for good fused particle binding, i.e., 3 to 5 percent by weight. Typically, these pellets have strength in excess of 40 psi. Vegetable oils are less expensive than petroleum oils especially when use is made of waste materials. In searching for additional sources of fixed oils, I have discovered a binder material that has as much as three times the strength of vegetable oil binders and six times the strength of asphaltic binders. Moreover, the agglomerates made using this binder are easily pulverized due to the strong but brittle nature of the binder. While vegetable oils have been found to work extremely well with most coals, it has not been found to work with lignite. The binder material disclosed herein is suitable for packaging lignite for shipment, i.e., producing a water-resistant lignite pellet.

SUMMARY OF THE INVENTION

Coal fines are slurried and screened to remove large chunks and particles. Preferably the particles larger than 28 mesh Tyler Series are removed. Generally speaking, a coal fine particle size of 60 to 200 mesh Tyler Sieve Series is most preferred.

The coal fines slurry is combined with a polymeric hydrocarbon binder having reactive sites thereon. "Reactive site" as used herein means and refers to functional groups covalently bonded to the polymer chain and which are reactive with each other and/or coal and lignite at temperatures up to 400° F., with the functional groups forming covalently bonded reaction products with each other and with coal or lignite. Typical functional groups present as reactive sites in the binder are hydroxyl, carboxyl, olefin, conjugated olefin, aldehyde, and abstractable hydrogen along the polymer chain. Sufficient reactive sites must be present in the hydrocarbon binder to form a network of crosslinkages between binder molecules themselves and/or the coal and lignite through the functional groups present thereon to provide a pellet having a compression strength of at least 40 psi at levels up to 5 percent by weight binder. Further, the pellet must not exhibit substantial compressiblity so that fracture occurs at its maximum compression strength without substantial deformation of the pellet. This characteristic is required for utilization of the pellets as fuel.

In addition, the hydrophobic nature of the binder, attributable to being a hydrocarbon, provides a water resistant pellet which is desirable since water should be eliminated from the pellet and not permitted to be absorbed upon storage to maintain a high BTU product.

Exemplary of the binders useful in the practice of the invention are both thermoplastic and thermosetting alkyd resins, phenolic resins made from the condensation of aldehydes and phenols, epoxy resins and the like. It is to be understood that although thermoplastic resins are not designed to crosslink, upon heating to the elevated temperatures (i.e., up to 400° F.) in the process of the invention in the presence of oxygen, the thermoplastic binder reacts with itself and/or with the coal or lignite to form a crosslinked network and a high strength, water resistant pellet.

A particularly useful binder has been found to be tall oil and tall oil pitch. The particular utility of this material has been established because of its low cost and reactivity with itself and/or coal and lignite to form pellets of high strength and water resistance.

In a preferred embodiment, coal fines slurry is fed to a conditioning tank where tall oil, tall oil pitch or mixtures thereof (herein "tall oil binder") is mixed with the slurry. If tall oil pitch is used, it may be necessary to warm the pitch to render it in liquid form. Preferably, the amount of tall oil binder mixed with the water is between about 10 and 25 percent by weight of coal. The concentration of the coal in the liquid (tall oil binder plus water) is between about 10 and 25 percent by volume. The tall oil binder coats the coal surfaces so that the coated coal comprises between about 3 and 5 percent by weight binder which is approximately the right amount for forming the good fused coal pellets. The coal slurry mixed with tall oil binder is introduced into a flotation cell and the coated coal particles are separated from the excess tall oil binder and most of the water. The means for removing excess liquid includes vacuum filters, vibratory screens, centrifuges, and so forth. Some liquid not absorbed on the surfaces of the coal may be retained in order to facilitate the subsequent agglomeration or pelletization step. Separated oil water mixture may be returned for reuse.

A moisture containing cake of coal fines is then introduced into a mechanical pelletizer where pellets of coal are formed. The pelletizer may simply comprise a rotating dish or drum in which the cake breaks up and rolls into balls. A blast of hot air may be directed to the rolling pellets in the pelletizer to cause a certain amount of free drying. In another embodiment, the cake may be pressed into briquettes with briquetting rolls. In yet another embodiment, the filter cake is simply broken up into pieces on a conveyor belt.

According to yet another embodiment of this invention especially applicable to lignite, the fines are not slurried but are mixed directly with the tall oil binder in the pelletizer disc or drum. In the case of tall oil pitch, the pitch is heated prior to adding to the fines in an amount between about 3 and 6 percent by weight. Thereafter sufficient water is sprayed upon the tumbling mixture of coal fines and tall oil binder to enable the formation of pellets. In the case of lignite, the water is carefully controlled. No more than about 10 to 15 percent water is added.

The pelletized coal is then introduced into a dryer where water is removed and the pellet is fused. The dryer must not cause the coal fines to ignite. A temperature in excess of 150° F. is adequate. A slight vacuum might be desired to increase the drying rate.

Upon drying an extremely strong pellet is recovered. The pellet is water-resistant and even to a degree water repellent. The pellet has the characteristic that it can be easily pulverized without gumming up the pulverizing machinery due to the hard brittle bond formed by the fine coal and tall oil binder.

DESCRIPTION OF THE PREFERRED EMBODIMENTS

In the following examples, the binder used is tall oil or tall oil pitch. Tall oil is a by-product of paper manufacture comprising about 45 to 50 percent fatty acids (mostly oleic or linoleic), 42 to 48 percent rosin acids, and the remainder other ingredients. It is obtained by solidifying the waste liquor residue of the Kraft paper process. When the tall oil is fractioned, for example, under vacuum conditions, a product comprising mostly fatty acids is derived. The remainder, i.e., the tall oil pitch is thus lower in fatty acids and higher in rosin acids and other ingredients. Tall oil is quite liquid at room temperature. Tall oil pitch is solid (something like room temperature margarine). By heating the tall oil pitch used in the following examples (obtained from Emery Industries, Cincinnatti, Ohio) it became quite liquid.

EXAMPLE I

North Dakota lignite was pulverized to pass 60 mesh U.S. Tyler Sieve Series. Five hundred grams of this material was mixed, by a hand held mixer with 40 grams of hot (140° F.) tall oil pitch. After complete mixing of tall oil pitch with lignite, the mixture was introduced into a laboratory pelletizer. During the rotation of the pelletizer a small quantity of water was sprayed upon this material to help it to agglomerate into large balls (1 inch and under). So formed material was then put into an oven and dried at the temperature of about 300° F.

The pellets were then tested for resistance to mechanical pressure, at which point they withstood a crushing pressure of 165 psi. The pellets were also totally waterproof. The grindability index of these lignite pellets was also improved. The raw material has had a grindability index of 29, the finished pellets had an index of 49 on Hardgrove scale. Obviously, the addition of tall oil pitch to lignite did improve its characteristics. High Hardgrove index indicates that the pellets can easily be crushed or pulverized utilizing existing equipment with no detriment to such an operation. This property of a coal pellet indicates that the binder material became part of the coal, adding to the strength of it.

EXAMPLE II

A mixture of coal and limestone was pelletized with the addition of this binder. Coal and limestone were finely pulverized. This mixture was introduced into the laboratory flotation cell, the purpose here was to agitate, and evenly coat all of the material particles with tall oil binder. The tall oil binder was added to this material at the rate of 8 percent by weight. The resulting coal and limestone mixture, after drying and cooling, had the following properties: resistance to crushing: 90 psig., resistance to crushing after soaking in water: 50 psig. The limestone does seem to absorb water, reducing the overall strength of the pellet.

By way of comparison, another mixture of coal and limestone material contained hydrolized starch and latex previously used as binder for this coal. Coal pellets were formed as described above, but when subjected to the soaking in water, pellets could be rubbed apart by finger pressure. The presence of starch and latex binder materials will affect the performance of the tall oil binder. Preferably, the coal must be very clean, and free of water absorbing materials, in order for the tall oil pitch binder to work properly.

EXAMPLE III

Noting that contaminants of coal seemed to prohibit proper performance of the tall oil binder material, I have first cleaned coal to be pelletized, to reduce ash and sulfur content by the means of my process, described in my presently pending U.S. patent application Ser. No. 135,241 utilizing ultrasound. During the last rinse stage, tall oil binder material was added to the clean coil in a flotation cell to simplify the dispersion and even coating of the coal particles. The excess liquid was filtered away from the coal, which was then introduced into the laboratory pelletizer. The rate of addition of the tall oil binder to coal was on the order of 4½ percent by weight of coal. Seemingly, there was a reduction in the quantity of binder required. Again, after drying, the coal pellets so formed were very strong and waterproof.

This above example illustrates that the cleaner the coal, the lesser amount of the tall oil pitch required as binder of coal. The strengths of the finished product are superior. Since tall oil pitch is a semi-solid at room temperature, it must first be heated to a temperature range of 100°–140° F. in order to be applied and to be evenly dispersed with coal particles. In order for a proper chemical reaction to take place between coal and tall oil pitch, elevated temperatures and oxygen (atmospheric) is required.

EXAMPLE IV

The process as described above for Example I was performed on a lignite having the following average analysis:

| Raw Lignite | |
|---|---|
| Moisture | 37.21% (by weight) |
| Ash | 8.58 |
| Volatile Matter | 26.46 |
| Fixed Carbon | 27.75 |
| BTU/pound | 6,629 |
| BTU/pound (dry basis) | 10,557 |
| Sulfur | 0.74% |
| Grind index (Hardgrove) | 29 |

After pelletizing, the analysis was as follows:

| Lignite Pellets | |
|---|---|
| Moisture | 4.69% (by weight) |
| Ash | 11.13 |
| Volatile Matter | 43.01 |
| Fixed Carbon | 46.17 |
| BTU/pound | 10,735 |
| BTU/pound (dry basis) | 11,263 |
| Sulfur | 0.71% |
| Grind index (Hardgrove) | 49 |

Summarizing according to one embodiment of this invention which is useful for typical coals (not lignite), coal fines are cleaned to make them as free of contaminants as possible with the available cleaning process. Preferably the fines are processed to reduce ash and sulfur content. Next the tall oil binder is added to the coal which has been slurried in water to provide an even coating of binder on the particle surfaces. The binder of tall oil pitch must be heated to about 100° to 140° F. to enable flow and easy mixing with the coal fines. Tall oil which is normally liquid at room temperature will not need to be heated. The excess water and tall oil binder is separated as by screen from the coal fines. At least 20 percent moisture remaining with the binder coated fines assists in forming pellets in the pelletizer. The coated fines are then tumbled in a pelletizer, either a drum or disc type, or are briquetted in a briquetting roll or agglomerated by some other process. The pellets formed in the pelletizer are dried in the atmosphere (which supplies oxygen) in a heated environment to fuse the coal fines and binder together.

According to another embodiment of this invention, useful for lignite coal, the lignite is first pulverized so that it can be easily coated with binder. The tall oil binder is then applied directly to the pulverized lignite either in a roller type mixture or the like prior to adding to the pelletizer or in the pelletizer itself. If tall oil pitch is used it must be heated. The coated lignite is then pelletized in a drum or disc type pelletizer or the like. A small amount of water must be sprayed on the coated fines in the pelletizer to cause agglomerating, i.e., the formation of pellets. The lignite pellets are heated in an atmosphere to at least 212° F. to fuse the binder and lignite.

The examples show that it is possible to form strong and water-resistant coal pellets. Water/coal/binder slurry is made only for the purpose of being able to evenly coat all of the particles of coal. This may be accomplished in any conventional mixing device, and as simple as a tank equipped with a propeller mixer. Forming of coal pellets can take place after excess moisture is removed from the fines coated with binder. A variety of conventional equipment can be applied to reduce the moisture content of the water/coal/binder slurry: shaker screens with openings small enough so as not to allow fine coal particles to pass through said openings, vacuum filters, centrifuges. "Dry" filter cake can then be introduced into an agglomerate forming device, such as: drum pelletizer, disc pelletizer, extruder. The method of forming the final shape of the product depends upon the desired shape of it. So shaped products must then be introduced into a dryer, which can be an oven, or a tunnel dryer, grate dryer, and so on. Airflow through said dryer must be so directed as to pass through the bed of agglomerates that are being dried. The time of retention of the material within the dryer will depend upon the temperatures involved.

Vegetable oils may be also used as extenders for the tall oil binder. The tall oil binders after they solidify, produce a much more brittle substance. This is a substantial benefit in the case of coal pellet, which may have to be pulverized prior to the combustion. The pulverizing process will be subject to less gumming, as may be the case with other binder materials, even vegetable oils. Tall oil binders are also nonvolatile.

Having thus defined the invention with the detail and particularity required by the Patent Laws, what is desired protected by Letters Patent is set forth in the following claims:

I claim:

1. A process for forming pellets from fine carbonaceous material comprising the steps for:
   (a) forming a water slurry of the material;
   (b) mixing the slurry with a binder comprising a tall oil binder selected from the group consisting of tall oil, tall oil pitch, and mixtures thereof;
   (c) separating the material from excess water and binder;
   (d) forming pellets from said material; and
   (e) heating said pellets in the presence of air at a temperature for a time long enough to fuse the carbonaceous materials and the tall oil binder.

2. A process according to claim 1 such that the binder fuses to form a network of crosslinkages between binder molecules themselves and/or the carbonaceous material to provide a pellet having a compression strength of 40 psi with the addition of up to 5% by weight binder.

3. A process according to claim 1 such that the binder fuses to form a pellet that does not exhibit substantial compressibility so that fracture occurs at its maximum compression strength without substantial deformation of the pellet.

4. A product according to the process of claim 1.

* * * * *